United States Patent [19]

Ushiyama

[11] 4,034,551

[45] July 12, 1977

[54] SAFETY FEATURE FOR FUNCTION CONTROL CIRCUIT

[75] Inventor: Yoshito Ushiyama, Okaya, Japan

[73] Assignee: Kabushiki Kaisha Suwa Seikosha, Tokyo, Japan

[21] Appl. No.: 577,964

[22] Filed: May 15, 1975

[30] Foreign Application Priority Data

May 15, 1974 Japan .....49-54193

[51] Int. Cl.[2] ..... G04B 19/27

[52] U.S. Cl. ..... 58/85.5; 58/23 R

[58] Field of Search ..... 58/23 R, 21.13, 22.9, 58/57, 85.5

[56] References Cited

U.S. PATENT DOCUMENTS

| | | | |
|---|---|---|---|
| 3,691,753 | 9/1972 | Kurita | 58/23 R |
| 3,756,015 | 9/1973 | Saito | 58/88.5 R |
| 3,762,153 | 10/1973 | Komiyama | 58/88.5 R |
| 3,871,168 | 3/1975 | Maire et al. | 58/23 R |
| 3,871,169 | 3/1975 | Schwaar | 58/85.5 |

*Primary Examiner*—Robert K. Schaefer
*Assistant Examiner*—Vit W. Miska
*Attorney, Agent, or Firm*—Blum, Moscovitz, Friedman & Kaplan

[57] ABSTRACT

A safety feature for a function control circuit particularly adapted for use with timing circuitry adapted to produce a time based signal is provided. A function signal circuit is adapted to produce either a first or a second function selecting signal. A multi-position switch is coupled to the function signal circuit and is adapted to remain in a quiescent position. The multi-position switch is further adapted to be manually displaced in a first direction to effect producing of a first function selecting signal by said function signal circuit and is further adapted to be manually displaced in a direction opposite to said first direction to effect producing by said function signal circuit of a second function selecting signal. An inhibit circuit is coupled to the timing circuit for receiving the time based signal and is also coupled to the function control circuit and multi-position switch and in response to displacement of the multi-position switch in the first direction inhibits producing of the second function selecting signal in response to displacement of said multi-position switch in the opposite direction within a predetermined interval of time after the multi-position switch means is returned from displacement in the first direction.

27 Claims, 8 Drawing Figures

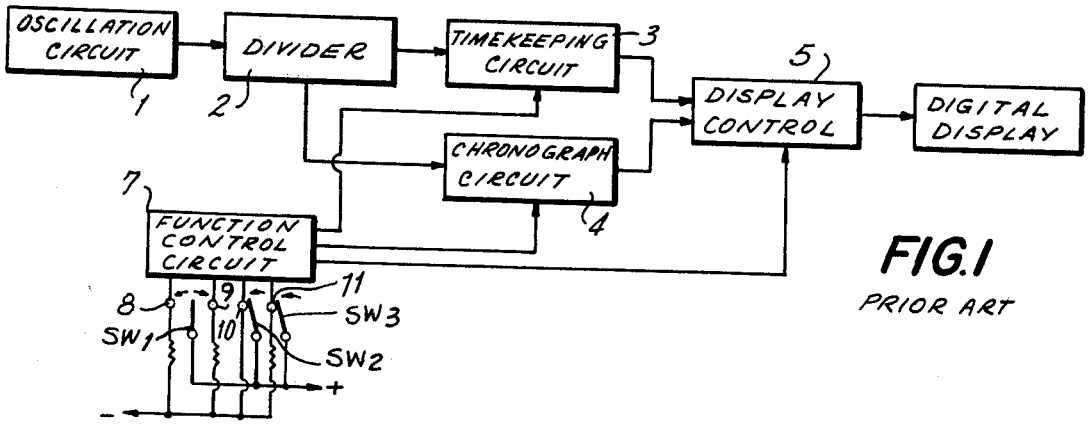
FIG.1
PRIOR ART
FIG.2
PRIOR ART
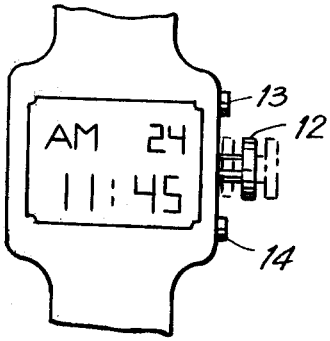
FIG.3
PRIOR ART
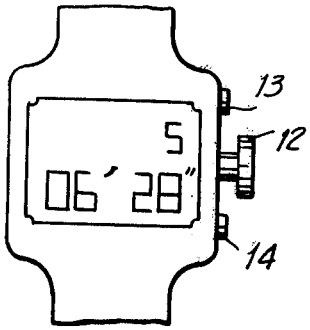
FIG.4
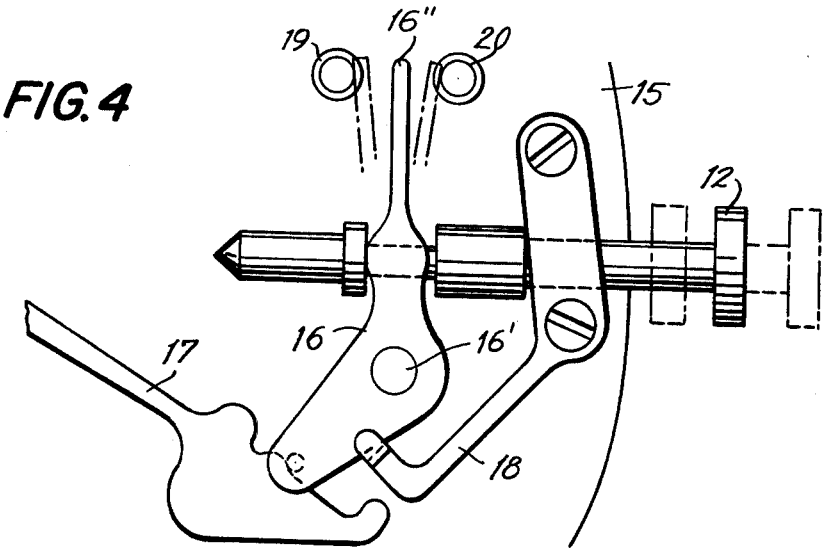

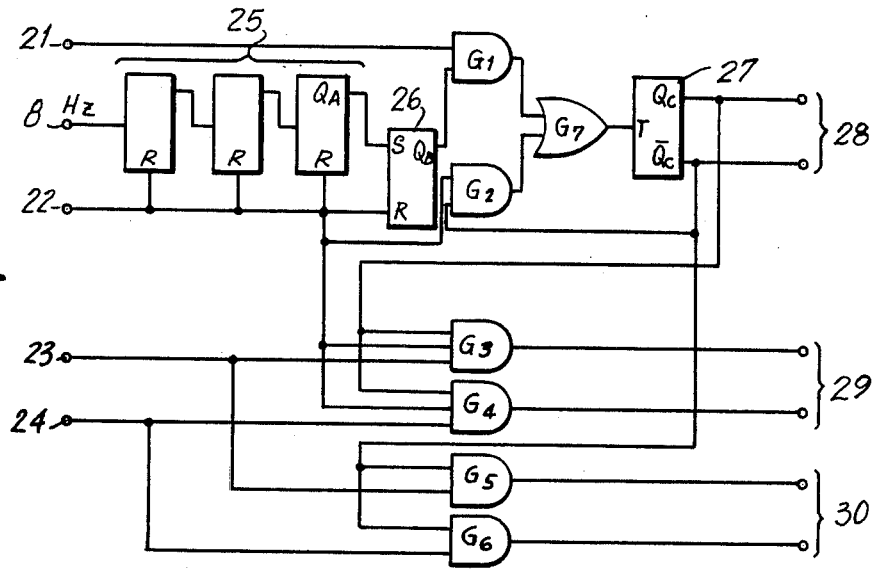
FIG.5
FIG.6
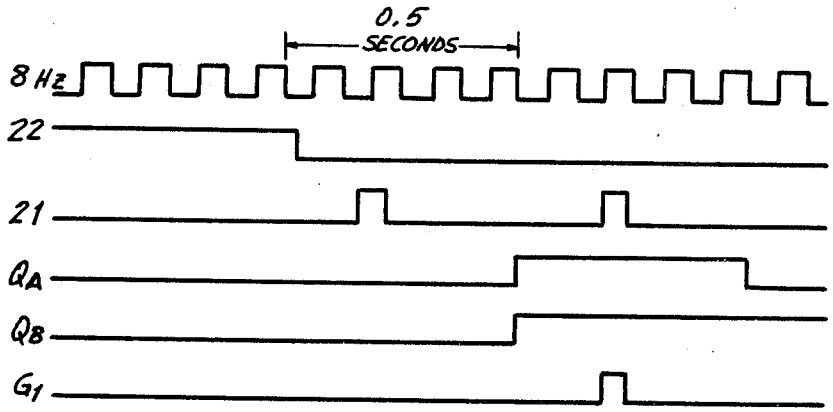
FIG.7
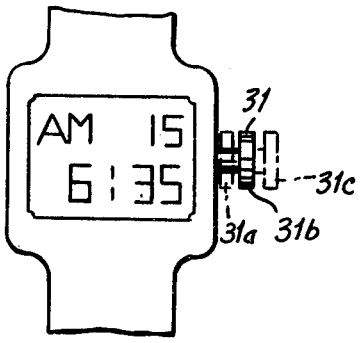
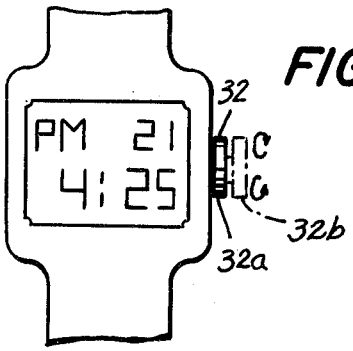
FIG.8

SAFETY FEATURE FOR FUNCTION CONTROL CIRCUIT

BACKGROUND OF THE INVENTION

This invention is directed to safety feature for a function control circuit and in particular to a safety circuit for a function control circuit particularly adapted for use with a timing circuit adapted to produce a time based signal to prevent erroneous function control thereof.

Although function control circuits controlled by manually operated switches disposed on the exterior of a device have taken on various forms, heretofor such function control devices have been particularly susceptible to inadvertent function selection caused by the use of a single manually operated switch to select more than one function. For example, in an electronic timepiece, the control of different functions such as time correction and alarm control are effected by a single manually operated switch selecting a first function in response to a pulling of same and a second function in response to a pushing of same. Inadvertent and erroneous function selection is also effected by rotatable switches adapted to effect selection of a first function in response to a rotation of the switch in a first rotational direction and selection of a second function in response to rotation in an opposite rotational direction.

The inadvertent and erroneous selection of an incorrect function in electronic timepieces has become particularly troublesome as the emphasis in electronic wristwatches has shifted from the mechanical display wristwatches wherein a hand or a disc is utilized to effect display to digital display wristwatches wherein a conventional seven-bar display formed of liquid crystals or light emitting diodes is utilized. By utilizing a quartz crystal oscillator circuit as a time standard and C-MOS integrated circuitry for producing low frequency time signals to be applied to the digital display elements, a highly accurate and small sized electronic wristwatch can be provided. Moreover, such diverse functions as chronography, alarms, the ability to instantaneously provide timing information corresponding to different time zones, and calculators have been included in such electronic wristwatches. Nevertheless, as the number of different functions and operations in electronic wristwatches have increased, so too has the number of manually operated switches required to effect same.

For example, in a chronographic wristwatch, a first switch means is required for effecting a selection of either a timekeeping mode of operation or an elapsed time measurement mode of operation. Additionally, a further switch is required for selecting the digit of time to be corrected (date, day, hour, minute, second, etc.), and still a further switch is required to control the elapsed time measurement functions found in a chronographic timepiece.

Nevertheless, because the fewest possible number of manually operated switches is a desired expedient for providing for simplicity of design and for maintaining the electronic wristwatch watertight, each switch or button is selected to perform as many functions as possible.

Specifically, a multi-position switch is pushed in and pulled out, or is rotated in a first or second direction in order to provide a selection of two different functions or operations by a single switch. Nevertheless, because of the small size of the switch, and the minimum displacement thereof to effect such function selection, inadvertent and erroneous selection of functions often results. Accordingly, a safety feature in a function control circuit to prevent inadvertent and erroneous function selection in response to manual operation of a multi-position switch is desired.

SUMMARY OF THE INVENTION

Generally speaking, in accordance with the invention a function control circuit including a safety feature for use in combination with timing circuitry adapted to produce a time based signal is provided. A function selecting circuit is adapted to produce a first or a second function selecting signal. A multi-position switch is coupled to the function selecting circuit and is adapted to remain in a quiescent position. The multi-position switching device is further adapted to be displaced in a first direction to effect the producing of a first function selecting signal by the function selecting means and is further adapted to be displaced in a direction opposite to said first direction to effect producing by said function selecting circuit of a second function selecting signal. An inhibit circuit is coupled to the function selecting circuit, multi-position switch and the timing circuit and in response to the time based signal and the displacement of the multi-position switch in the first direction inhibits selection of a second function selecting signal in response to displacement of the switch in an opposite direction within a predetermined interval of time after the multi-position switch is returned from displacement in a first direction.

Accordingly, it is an object of this invention to provide an improved function control circuit including a safety feature for preventing erroneous and inadvertent function selection.

Still a further object of this invention is to provide an improved manually operated function control circuit particularly adapted for use in an electronic timepiece.

Still another object of this invention is to provide an improved electronic timepiece function control circuit wherein errorless function selection is provided.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a block circuit diagram of a chronographic electronic wristwatch constructed in accordance with the prior art;

FIG. 2 is a perspective view of the chronographic wristwatch depicted in FIG. 1 in a timekeeping mode;

FIG. 3 is a perspective view of the front of the chronographic wristwatch depicted in FIG. 1 in a chronographic mode of operation;

FIG. 4 is a plan view of the multi-position function mode selection switch adapted to select the timekeeping and chronographic modes depicted in FIGS. 2 and 3;

FIG. 5 is a block circuit diagram of a function control circuit including a control circuit constructed in accordance with the instant invention;

FIG. 6 is a wave diagram representative of the operation of the function control circuit depicted in FIG. 5;

FIG. 7 is a perspective view of a chronographic wristwatch constructed in accordance with the preferred embodiment depicted in FIG. 5; and FIG. 8 is a perspective view of a further chronographic wristwatch constructed in accordance with a preferred embodiment depicted in FIG. 5.

DETAILED DESCRIPTION OF THE PREFERRED EMBODIMENTS

Reference is now made to FIGS. 1 through 4 wherein an electronic chronographic wristwatch constructed in accordance with the prior art is depicted. An oscillator circuit 1 having a quartz crystal vibrator adapted to vibrate and produce an oscillation frequency on the order of several tens KHz applies a high frequency time-standard signal to a divider circuit 2. Divider circuit 2 in response to the high frequency time standard signal applies a timekeeping signal to timekeeping circuit 3 and a higher frequency elapsed time signal to chronograph circuit 4. The elapsed time signals counted by the chronographic circuit 4 and the timekeeping signals counted by timekeeping circuit 3 are respectively applied to a display control circuit 5, which circuit selects a chronographic mode to effect display of elapsed time signals or in the alternative selects a timekeeping mode to effect display of present time. As is specifically depicted in FIG. 2, the timekeeping circuit 3 is adapted to produce hours (11), minutes (45), date (24), and 12 hour segment of the day (AM) signals for digital display. Similarly, as specifically depicted in FIG. 3, the chronographic divider circuit 4 is adapted to function as a stop-watch for measuring elapsed time and produces elapsed time signals representative of minutes (06), seconds (28) and tenths of seconds (5) for digital display. The digital display is formed of conventional 7-bar segmented digital display elements such as liquid crystals or light emitting diodes.

Selection and control of the respective functions performed by the electronic wristwatch, namely, operation of the wristwatch in a chronographic mode as a stop-watch, correction of the time displayed by the wristwatch in a time-keeping mode, and selection of either the timekeeping mode or chronographic mode are effected by a function control circuit 7 and switches $SW_1$, $SW_2$ and $SW_3$ coupled thereto. The function control circuit is respectively coupled to time-keeping circuit 3, chronographic circuit 4 and display control circuit 5. Additionally, function control circuit 7 includes four input terminals, 8, 9, 10 and 11, each terminal being respectively coupled through a high impedance to a common negative (−) reference potential. Accordingly each of the terminals 8 through 11 is maintained at a LOW or 0 state. Switches $SW_1$, $SW_2$ and $SW_3$ are respectively coupled to a common positive (+) potential. Referring specifically to FIGS. 2 and 3, multi-position switch 12 corresponds to switch $SW_1$ and is adapted to be displaced in a first direction, such as pushing to effect contact with input terminal 8, and is adapted to effect contact with input terminal 9 in response to displacement of multi-position switch 12 in the opposite direction by a pulling of same. Swtiches 13 and 14 respectively correspond to switches $SW_2$ and $SW_3$ and are closed in response to a pushing of same.

The multi-position switch 12 is more specifically depicted in FIG. 4 and includes a base member 15 referenced to a positive (+) potential. The multi-position member 12 is adapted to be pushed in or pulled out to the positions indicated by the dashed lines. A contact spring lever 16 is secured to the multi-position member 12 and is pivotally secured to base plate 15 at pivot 16′ to effect a displacement of moving contact 16″ into contact with fixed contact terminals 19 or 20. A positioning spring 17 maintains contact spring lever 16 out of contact with fixed contact terminals 19 and 20 in the absence of manually applied force to the multi-position member 12. Nevertheless, when multi-position member 12 is pulled out, the moving contact portion 16″ of the contact spring lever engages the contact terminal 20 and is maintained in engagement therewith by positioning spring 17. Similarly, pushing in of multi-position member 12 effects a pivoting of the contact spring lever into engagement with fixed contact terminal 19. When the pressure applied to the multi-position member 12 to effect an inward displacement of same is removed, the contact spring lever 16 is returned to quiescent position by return spring 18.

With respect to the operation of the multi-position switch 12, pulling the multi-position switch 12 to bring the contact spring lever 16 into engagement with fixed contact terminal 20 corresponds to a displacement of switch $SW_1$ into contact with input terminal 9 of the function control circuit and effects a selection of a timekeeping mode. Thereafter, closings of switches $SW_2$ and $SW_3$ effects correction of the count of the timekeeping circuit. In the alternative, a pushing of the multi-position switch 12 to effect engagement of contact spring lever 16 with fixed contact terminal 19 corresponds to displacement of switch $SW_1$ into contact with input terminal 8 to effect a selection by display control circuit 5 of the elapsed time signals produced by chronographic circuit 4 and hence a display of the chronographic information depicted in FIG. 3. When the multi-position switch 12 is in the pushed in position, the switches $SW_2$ and $SW_3$ corresponding to push button switches 13 and 14 are utilized to respectively effect start-stop control and lap-reset control of the chronographic circuitry.

As noted above, time correction is effected in response to a pulling out of the multi-position member to render operative push button switches 13 and 14 as correction switches. After correction is made, the multi-position switch 12 is returned to a quiescent position whereafter the wristwatch operates in a timekeeping mode whereby present time is displayed. Nevertheless, as the multi-position switch 12 is returned to the quiescent position quite often same is pushed too strongly or the quiescent position is not easily ascertained, and as a result of such pushing, the multi-position member 12 is displaced to the pushed in position hence causing contact spring lever 16 to inadvertently engage fixed contact terminal 19 and inadvertently cause a change of the wristwatch into a chronographic mode whereby elapsed time signals are displayed by the digital display. In order to return the wristwatch to a timekeeping mode whereby present time is displayed, it is then necessary to once again pull out the multi-position member 12 to the pulled out position and thereafter, carefully return same to the quiescent position. Accordingly, as is detailed below, the instant invention prevents such inadvertent and otherwise erroneous selection of chronographic operation by preventing the selection of a chronographic mode until a predetermined interval of time after the multi-position member 12 is returned from the pulled out time correcting position Reference is now made to FIG. 5 wherein a circuit diagram of a function control circuit including a safety feature in accordance with the instant invention is depicted. Input terminals 21, 22, 23 and 24 respectively correspond to input terminals 8, 9, 10 and 11 of the function control circuit 7 illustrated in FIG. 1. Accordingly, input terminals 21 through 24 are maintained at a LOW or 0 reference potential during normal operation of a wristwatch. Three series connected flip-flops comprise a delay circuit 25. The delay circuit 25 is adapted to receive an intermediate frequency signal such as an 8 Hz signal from divider circuit 2 and in response thereto effect division by $2^3$ to thereby produce a 2 Hz output $Q_A$ to a set-reset flip-flop circuit 26. The output $Q_B$ of set-reset flip-flop 26 is applied as a first input to gate circuit $G_1$. The other input to gate circuit $G_1$ is the input terminal 21 corresponding to input terminal 8 in FIG. 1. Each of the flip-flops comprising delay circuit 25 and set-reset flip-flop 26 have coupled to the reset terminal thereof input terminal 22 which terminal corresponds to input terminal 9 of FIG. 1. Additionally, input terminal 22 is coupled as a first input to gate circuit $G_2$. The output of gates $G_1$ and $G_2$ are applied as respective inputs to gate circuit $G_7$ which gate in response to a positive pulse applied to either input or both inputs applies a pulse to the T terminal of a T-type flip-flop 27 adapted to change state in response to each pulse applied to the T terminal thereof. T-type flip-flop 27 produces complementary clock pulses $Q_c$ and $\overline{Q_c}$ across terminal 28, the respective states of the terminals producing a first or second counting mode function selecting signal. Specifically, when $Q_c$ is a 1 and $\overline{Q_c}$ is a 0, the circuit selects a timekeeping mode and present time is displayed, and when $Q_c$ is a 0 and $\overline{Q_c}$ is a 1 the wristwatch is placed in chronographic mode and counts elapsed time. The signal $\overline{Q_c}$ is also applied as the further input to gate circuit $G_2$.

Gate circuits $G_3$ and $G_4$ produce output signals at terminals 29 and are adapted to apply correction function signals when the timepiece is in a timekeeping correction mode. Accordingly, the output of the T-type flip-flop $Q_c$ is coupled to respective first inputs of gate circuits $G_3$ and $G_4$. Additionally, input terminal 22 is coupled as a further input to each of the gate circuits $G_3$ and $G_4$, and finally input terminals 23 and 24 represent the respective third inputs to circuits $G_3$ and $G_4$. Gate circuits $G_3$ and $G_4$ effect an AND operation whereby a signal is produced only in response to all HIGH or 1 inputs applied thereto. Similarly, gate circuits $G_5$ and $G_6$ have as first inputs the signal produced at the output terminal $\overline{Q_c}$ of the T-type flip-flop 27 and as the further input, input terminals 23 and 24, and as detailed below, operate in the same manner as gating circuits $G_3$ and $G_4$ to effect control of the chronographic functions when the wristwatch is in a chronographic mode.

Referring specifically to FIGS. 5 and 6, the operation of the function control circuit including the safety feature of the instant invention is better understood. During normal operation in the timekeeping mode, whereby present time is displayed, the T-type flip-flop 27 is set so that $Q_c$ is 1 and $\overline{Q_c}$ is 0. In response to a pulling out of the multi-position switch 12, the input terminal 22 is placed at a HIGH potential, thereby effecting a resetting to 0 of each of flip-flops comprising delay circuit 25, a resetting to 0 of flip-flop 26, and hence an output 0 produced by gate $G_1$ and in further view of output terminal $\overline{Q_c}$ of flip-flop 27 being at 0, a 0 output is produced by gate circuit $G_2$. Accordingly, no change in the state of the T-type flip-flop 27 is effected, and the timepiece remains in a timekeeping mode. Moreover, referencing the input terminal 22 to a HIGH potential effects a HIGH or 1 input at the first terminal of gates $G_3$ and $G_4$. Also,as noted above, since a second input terminal of gating circuits $G_3$ and $G_4$ are referenced to the terminal $Q_c$ which is set at a 1 state, the second input terminal is set to a 1 state. Accordingly, in response to a closing of the switches 10 and 11 corresponding to input terminals 23 and 24, index correction signals are selectively applied to the timekeeping divider circuits at terminals 29 in a conventional manner.

After correction, if the multi-position switch 12 is returned to a quiescent position, the electronic timepiece continues to operate in a timekeeping mode. However, if the multi-position switch 12 is pushed all the way to the pushed in position, the input terminal is referenced to a HIGH potential and as is depicted in FIG. 6, the input terminal 22 is referenced to a LOW potential. Nevertheless, because each of the flip-flops comprising delay circuit 25 and said reset flip-flop 26 are reset to 0 immediately prior to the pushing in of the multi-position switch 12 from the pulled out position, the outputs $Q_A$ and $Q_B$ are zero immediately after the multi-position member is pushed to the innermost position. Accordingly, the the input $Q_B$ to gate circuit $G_1$ is a 0 and prevents the application of a 1 to gate circuit $G_7$. Similarly, since input terminal 22 is referenced to a LOW potential, a first input to gate circuit $G_2$ is 0 and prevents a pulse from being applied to gate circuit $G_7$. Nevertheless, a 2 Hz signal is produced by delay circuit 25 in response to the 8 Hz signal applied thereto. 0.5 seconds after the input terminal 22 is referenced to a LOW potential a HIGH or 1 signal is applied to the S terminal of flip-flop circuit 26 to thereby effect a corresponding HIGH or 1 input $Q_B$ applied to gate circuit $G_1$. Thereafter, maintaining the multi-position switch 12 in a pushed in position or displacing same to the pushed in position produced a HIGH or 1 pulse as the other input to gate $G_1$ and in turn effects a change in state of the outputs $Q_c$ and $\overline{Q_c}$ of T-type flip-flop 27 to a 0 and 1 respectively, to thereby effect a change from a timekeeping mode to a chronographic mode. Moreover, the change in state of the terminal $\overline{Q_c}$ from a LOW to a HIGH potential effect a HIGH input to gates $G_5$ and $G_6$, and in response to selective actuation of the switches at input terminals 23 and 24 effects stop-watch and lap control of the chronographic timepiece. Thereafter, return of the multi-position switch 12 to the pulled out position momentarily will effect a resetting to 0 of the flip-flops, a change in state of flip-flop circuit 27, and hence a return to the timekeeping mode and a positioning of the multi-position switch in a quiescent position. Accordingly, use of the function control circuit of the instant invention inhibits erroneous or inadvertent selection of a second function or operation of a timepiece in response to a return of a multi-position selection switch from a first function selecting position.

Reference is now made to FIG. 7 wherein an electronic wristwatch having a manually operable multi-position switch 4 effecting correction of the date, hour and minute units of time displayed by use of a function control circuit in accordance with the instant invention is depicted. The multi-position switch 31 has the same structure as depicted in FIG. 4 and hence provides function selection in response to a pulling out or pushing in of the switch. If manually operated switch 31 is pulled out to the position 31*c* from the quiescent position 31*b*, a digit of time to be corrected is selected. By repeating the pulling out to position 31*c* and the return of same to the normal position 31*b*, the digits of time to be corrected are serially selected in the following order, second → date → hour → minute → and second → . The sequential selection of a digit of time to be corrected in the manner detailed above is achieved by providing a binary counter capable of selecting respective functions in response to the indexing of the count thereof and although readily available for use in combination with the instant invention does not fall within the scope of this invention.

After selection of the digit of time to be corrected, a pushing in of the switch member 31 from quiescent position 31*b* to pushed in position 31*a*, effects the application of an index pulse to the divider stage providing the timekeeping signals to the digit of time to be displayed to thereby effect an indexing of the count thereof by 1, and hence an indexing by 1 correction for each pushing in of the switching member 31. Accordingly, when it is desired to effect date correction without correcting the seconds digit of time, the date correction can be selected by pulling out the switching member a sufficient number of time to effect selection of the date counter whereafter pushing in effects the necessary index correction. Nevertheless, if after each pulling out of the switch member 31 to effect selection of the proper digit of time to be corrected, the switching member were inadvertently pushed in, during selection of the digit of time to be corrected, the possible inadvertent correction of the seconds digit of time prior to selection of the date digit of time would become a likely possibility. Nevertheless, in accordance with the instant invention, by providing a function control circuit wherein selection of the second function is inhibited until the predetermined interval of time after the first function is selected, such erroneous and inadvertent time correction is prevented.

Reference is also made to FIG. 8 wherein an electronic wristwatch including a function control circuit in accordance with the instant invention is embodied in a further multiposition switch arrangement. The multiposition switch 32 is adapted to be pulled out from position 32*a* to position 32*b*, whereafter a digit of time to be corrected is selected in the same order indicated above:

second → date → hour → minute → second → by a clockwise rotation of the pulled out switch member 32, whereafter indexing of the divider stage corresponding to the digit of time selected is effected by a counterclockwise rotation of the rotatable switching member 32. Accordingly, as in the embodiment depicted in FIG. 7, if the date is to be corrected, without effecting a change in the seconds digit of time, the date is selected by pulling out the rotating switch member 32 and effecting two rotations of the rotatable member 32 in a clockwise direction to first effect selection of the second digit of time in response to the first clockwise rotation, and thereafter the date digit of time in response to the second clockwise rotation of the switch member 32. Nevertheless, if after the first rotation of the switch member 32, as same is returned to the quiescent position by counterclockwise rotation, often the switching member will be rotated past the normal position and will effect a counterclockwise rotation through a sufficient angle to effect an erroneous or inadvertent correction of a digit of time not needing correction. Accordingly, by utilizing the inhibit safety feature of the instant invention, such erroneous and inadvertent correction is inhibited during a predetermined interval of time after each function selection operation is effected in response to first clockwise rotations of the rotational switching member.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A function control circuit comprising in combination, function selecting means for producing one of a first and second function selecting signal, a multi-position switch means coupled to said function selecting means, said multi-position switch means being maintained in a quiescent position and being adapted to be displaced in a first direction to effect producing of a first function selecting signal by said function selecting means, and being further adapted to be displaced from a quiescent position in a second direction opposite to said first direction to effect producing of a second function selecting signal by said function selecting means, and inhibit means coupled to said multi-position switch means and said function selecting means, said inhibit means being disposed in response to displacement of said multi-position switch means in said first direction to inhibit producing of a second function selecting signal, said inhibit means in response to the return of said multi-position switch means from said first displaced direction being adapted to inhibit producing of said second function selecting signal until a predetermined interval of time after said multi-position switch means is returned from said first displaced direction.

2. A function control circuit as claimed in claim 1, wherein said inhibit means includes delay means coupled to said multi-position switch means, said delay means coupled to said multi-position switch means, said delay means being reset in response to a displacement of said multi-position switch means in said first direction and applying an inhibit signal to said function selecting signal producing means to inhibit a change in function selecting signal produced thereby, said delay means, in response to a return of said multi-position switch means from displacement in said first direction, terminating application of said inhibit signal to said function selecting means a predetermined interval of time after said switch means is returned from said first displaced direction.

3. A function control circuit as claimed in claim 1, wherein said multi-position switching means is a push pull switch, said first displacement direction being a pulled out direction, and said second opposite direction being a pushed in position.

4. A function control circuit as claimed in claim 1, wherein said multi-position switching means includes a member adapted to be displaced in a first direction by pulling same and effecting rotation in a first rotational direction, and being displaced in the opposite direction by being pulled out and rotated in the opposite rotational direction.

5. A function control circuit as claimed in claim 2, wherein said delay means includes timing means for producing a time based signal and a plurality of series-connected divider stages adapted to receive said time based signal and be reset in response to displacement of said multi-position switch means in said first direction, said series-connected divider stages being adapted to terminate application of said inhibit signal at a predetermined interval of time after said multi-position switch means is returned from said first displaced direction.

6. A function control circuit as claimed in claim 5, wherein said inhibit means further includes set-reset means disposed intermediate said series-connected divider stages and said function selecting means, and in response to said displacement of said switch means in said first direction being reset to apply an inhibit signal to said function selecting means to inhibit application of any further signals thereto, and in response to said signal produced by said delay means a predetermined interval of time after said multi-position switch means is returned from said first displaced direction, being set and in response thereto terminating application of said inhibit signal to said function selecting means.

7. A function control circuit as claimed in claim 6, wherein said function selecting means includes flip-flop means adapted to effect a change of the function selecting signal produced thereby in response to each signal applied thereto, and gate means intermediate said set-reset means and said flip-flop means and in response to application of said inhibit signal thereto, preventing application of signals to said flip-flop means.

8. A function control circuit as claimed in claim 7, and including two manually operated two position switches for applying function control signals, first control means coupled to said first and second manually operated switches and further coupled to said function selecting means, and second control means coupled to said switches and also coupled to said function selecting means, said first control means being adapted to produce control signals in response to actuation of said manually operated switches in response to the producing of a first function selecting signal by said function selecting means, and said second control means being adapted to produce control signals in response to actuation of said manually operated switches in response to producing of a second function selecting signal by said function selecting means.

9. In an electronic timepiece including timekeeping means for producing timekeeping signals and display means for displaying time in response to said timekeeping signals, the improvement comprising first and second function control means, function selecting means coupled to said first and second function control means and producing one of a first and second function control selecting signal, a multi-position switch means coupled to said function selecting means, said multi-position switch means being maintained at a quiescent position and being adapted to be displaced in a first direction to effect producing of a first function control selecting signal by said function selecing means, and being further adapted to be displaced from a quiescent position in a second direction opposite said first direction to effect producing of a second function control selecting signal by said function selecting means, and inhibt means coupled to said multi-position switch means and said function selecting means, said inhibit means being disposed in response to displacement of said multi-position switch means in said first direction to thereby inhibit producing of said second function control selecting signal, said inhibit means in response to said multi-position switch means being returned from said first displaced direction inhibiting producing of said second function control signal until a predetermined interval of time after said multi-position switch means is returned from said first displaced direction.

10. An electronic timepiece as claimed in claim 9, wherein said inhibit means includes delay means coupled to said multi-position switch means, said delay means being reset in response to displacement of said multi-position switch means in said first direction and applying an inhibit signal to said function control selecting signal producing means to inhibit a change in the function control selecting signal produced thereby, said delay means in response to a return of said multi-position switch from displacement in said first direction terminating application of said inhibit signal to said function selecting means a predetermined interval of time after said multi-position switch means is returned from said first position.

11. An electronic timepiece as claimed in claim 9, wherein said multi-position switch means is a push pull switch, said first displacement direction being a pull out direction, and said second opposite direction being a push in position.

12. An electronic timepiece as claimed in claim 9, wherein said multi-position switch means includes a member to be displaced in a first direction by pulling same and effecting rotation in a first rotational direction, and being displaced in the opposite direction by being pulled out and rotated in the opposite rotational direction.

13. An electronic timepiece as claimed in claim 10, wherein said timekeeping means includes an oscillator means for producing a high frequency time standard, and a divider means for producing an intermediate frequency signal in response to said high frequency time standard signal, said delay means including a plurality of series-connected divider stages adapted to receive said intermediate frequency signal and be reset in response to displacement of said multi-position switch means in said first direction, said series-connected divider stages being adapted to terminate application of said inhibit signal at a predetermined interval of time after said multi-position switch means is in returned from said first displaced direction.

14. An electronic timepiece as claimed in claim 13, wherein said inhibit means further includes set-reset means disposed intermediate said series-connected divider stages and said function selecting means, and in response to said displacement of said switch means in said first direction being reset to apply an inhibit signal to said function selecting means to inhibit application of any further signals thereto, and in response to said signal produced by said delay means a predetermined interval of time after said multi-position switch means is returned from said first displaced direction, being set and in response thereto terminating application of said inhibit signal to said function selecting means.

15. An electronic timepiece as claimed in claim 14, wherein said function selecting means includes flip-flop means adapted to effect a change of the function control selecting signal produced thereby in response to each signal applied thereto, and gate means intermediate said set-reset means and said flip-flop means and in response to application of said inhibit signal thereto, preventing application of signals to said flip-flop means.

16. An electronic timepiece as claimed in claim 15, said timekeeping means also including timekeeping divider means coupled to said first mentioned divider means and in response to signals produced thereby producing low frequency timekeeping signals representative of present time, said timekeeping means further including chronographic divider means coupled to said first-mentioned divider means and in response to signals produced thereby producing chronographic timekeeping signals representative of elapsed time, and display control means coupled to said timekeeping divider means and to said chronographic divider means, and in response to said low frequency timekeeping signals and said elapsed time signals applied thereto, applying one of said timekeeping signals and elapsed time signals to said digital display means.

17. An electronic timepiece as claimed in claim 16, wherein said display control means is coupled to said function selecting means and is adapted to apply to said digital display means said low frequency timekeeping signals in response to said first function selecting signal and to apply said elapsed time signals to said display means in response to said second function control selecting signal produced by said function selecting means.

18. An electronic timepiece as claimed in claim 17, wherein said first function control means is coupled to said timekeeping divider means, and said second function control means is coupled to said chronographic divider means, and further including two manually operated two position switches, first timekeeping control means coupled to said first function control means, said first and second manually operated switches and said function selecting means, and second chronographic control means coupled to said second function control means, said manually operated switches, and said function selecting means, said first timekeeping control means being adapted to apply timekeeping control signals to said first function control means in response to actuation of said manually operated switches in response to the producing of a first function control selecting signal by said function selecting means, and said second chronographic control means being adapted to apply chronographic control signals to said second function control means in response to actuation of said manually operated switches in response to producing of said second function control selecting signal by said function selecting means.

19. A function control circuit for preventing inadvertent function selection comprising multi-position manually operated switch means displaceable from a quiescent position to one of a first and second function selecting position, and function selecting circuit means coupled to manually operated switch means for selecting no function when said manually operated switch means is in a quiescent position and one of a first function and second function in response to said displacement of said switch means from a quiescent position to one of said first and second function selecting positions, respectively, said function selecting circuit means including inhibiting means for inhibiting said function selecting circuit from selecting said second function until a predetermined interval of time after said manually operated switch means is returned to said quiescent position from said first function selecting position.

20. A function control circuit as claimed in claim 19, wherein the said multi-position manually operated switch means includes a switching member displaceable in first and second opposite directions from said quiescent position for selecting a first function selecting position and second function selecting position respectively.

21. A function control circuit as claimed in claim 19, wherein said inhibit means includes delay means coupled to said multi-position switch means, said delay means in response to a displacement of said multi-position switch means to said first displaced position being reset to thereby apply an inhibit signal to said function selecting circuit means to inhibit a change in the function selected thereby, said delay circuit in response to the return of said multi-position switch to said quiescent position from displacement to said first position terminating application of said inhibit signal to said funtion selecting circuit means after said predetermined interval.

22. A function control circuit as claimed in claim 20, wherein said first and second directions are defined by pushing and pulling said switching member.

23. A function control circuit as claimed in claim 20, wherein said first and second directions are opposite rotational directions.

24. A function control circuit as claimed in claim 21, wherein said delay means includes timing means for producing a time based signal and a plurality of series-connected divider stages adapted to receive said time based signal and be reset in response to displacement of said multi-position switch means in said first direction, said series-connected divider stages being adapted to terminate application of said inhibit signal at a predetermined interval of time after said multi-position switch means is returned to said quiescent position from said first displaced position.

25. A function control circuit as claimed in claim 24, wherein said inhibit means further includes set-reset means disposed intermediate said series-connected divider stages and said function selecting circuit means, and in response to said displacement of said manually operated switch means to said first displaced position being reset to apply an inhibit signal to said function selecting circuit means to prevent application of any further signals thereto, and in response to said signal produced by said delay means a predetermined interval of time after said multi-position switch means is returned to said quiescent position from said first displaced direction, being set, and in response thereto terminating application of said inhibit signal to said function selecting means.

26. A function control circuit as claimed in claim 25, wherein said function selecting circuit means includes flip-flop means adapted to effect a selection of a different function in response to each signal applied thereto, and gate means intermediate said set-reset means and said flip-flop means and in response to application of said inhibit signal thereto, preventing application of signals to said flip-flop means.

27. A function control circuit as claimed in claim 26, and including two manually operated two position switches for applying function control signals, first control means coupled to said first and second manually operated switches and further coupled to said function selecting circuit means, and second control means coupled to said switches and also coupled to said function selecting circuit means, said first control means being adapted to produce control signals in response to actuation of said manually operated switches in response to the selecting of a first function by said function selecting circuit means, and said second control means being adapted to produce control signals in response to actuation of said manually operated switches in response to said function selecting circuit means selecting a second function.

* * * * *